US005216444A

United States Patent [19]

Noguchi et al.

[11] Patent Number: 5,216,444

[45] Date of Patent: Jun. 1, 1993

[54] APPARATUS FOR CONTROLLING REFERENCE POSITION OF PAPER IN A MULTIPLE-TIME RECORDER AND CONTROL METHOD THEREOF

[75] Inventors: Masatoshi Noguchi; Toshiya Watanabe; Mitubu Yokoyama; Kouji Shimizu, all of Tokyo, Japan

[73] Assignee: Graphtec Kabushiki Kaisha, Tokyo, Japan

[21] Appl. No.: 580,103

[22] Filed: Sep. 7, 1990

[30] Foreign Application Priority Data

Apr. 13, 1990 [JP] Japan ..... 2-96214
Jun. 22, 1990 [JP] Japan ..... 2-162748

[51] Int. Cl.[5] ..... B41J 11/42

[52] U.S. Cl. ..... 346/136; 226/1; 226/2; 400/579; 400/580; 400/582; 400/583

[58] Field of Search ..... 346/1.1, 136, 76 PH; 400/120, 579, 580, 582, 583; 226/1, 2; 355/308, 317

[56] References Cited

U.S. PATENT DOCUMENTS 4,734,868 3/1988 DeLacy ..... 364/519
4,839,674 6/1989 Hanagata et al. ..... 346/136
4,916,638 4/1990 Haselby et al. ..... 346/154

*Primary Examiner*—Benjamin R. Fuller
*Assistant Examiner*—Huan Tran
*Attorney, Agent, or Firm*—Spensley Horn Jubas & Lubitz

[57] ABSTRACT

In a multiple-time recorder in which different colored recordings are superimposed on a single sheet to draw a multi-colored drawing, the reference position of the recording paper must remain at a same point for each-time drawing of a single color. At an initialization, a physical property of the recording paper is measured as a function of the paper position including the reference position, and this function is stored in a reference data memory. Before the commencement of the next and subsequent recordings, the same physical property is measured and stored in a compared data memory. From the cross correlation of the contents of the compared data memory and those of the reference data memory, the reference position for the next and subsequent recordings is precisely determined.

13 Claims, 4 Drawing Sheets

APPARATUS FOR CONTROLLING REFERENCE POSITION OF PAPER IN A MULTIPLE-TIME RECORDER AND CONTROL METHOD THEREOF

BACKGROUND OF THE INVENTION

The present invention relates to an apparatus for controlling the reference position of a recording paper in a multiple-time recorder, such as a polychrome recorder, in which recordings of different colors are superimposed on a single sheet of recording paper.

In a typical polychrome recorder, there is a thermal transcription recorder in which recording paper is displaced in a forward and also in a backward direction, sandwiched between a platen roller and a thermal head. (refer to FIG. 5) This displacement of paper is driven by a pulse motor and when a pulse is input, the paper is displaced by a unit displacement which is a very small quantity in a forward or in a backward direction. The drive direction is controlled by a different signal which is supplied to a motor control circuit.

Thus, in the transcription recorder, the recording paper is driven forward or backward in recording direction to change the relative position between the recording paper and the thermal head by a desired amount of displacement for recording on the recording paper.

The transcription recorder has an up-down counter for counting the number of pulses input to the motor control circuit. The up-down counter is reset at a reference position between the recording paper and the thermal head. The reference position is the base position at commencement of recording. A pulse for rotation in the forward direction is up-counted while a pulse for rotation in the backward direction is down-counted. The relative position of the recording paper and the thermal head can be indicated by the count value of the up-down counter, the count value of 0(zero) indicating the reference position.

There are provided ink ribbons of different colors, for example, an ink ribbon of yellow color, that of magenta color, that of cyan color, etc. When polychrome recording is performed, the paper is positioned at the reference position between the recording paper and the thermal head. An ink ribbon of, e.g., yellow color is overlaid on the paper and they are displaced in the forward direction to record a yellow color recording on the paper. When the yellow color recording is completed, the paper is returned to the reference position by displacing the paper in the backward direction. Then, the ink ribbon is changed to one having magenta color and the recording of magenta color is performed in the same way as mentioned above. As is apparent from the foregoing descriptions, it is indispensable to accurately accord the reference position of the recording in magenta color with that of the recording in yellow color. The position of the reference position is indicated by the count value of the up-down counter. However, the count value of the up-down counter may generate an error due to noise input. Moreover, due to the paper displacement of long distance in forward and backward directions fine slips between the platen roller and the paper are accumulated to generate an appreciable error. Therefore, another means to determine an accurate reference position is required in addition to the count value of the up-down counter.

In a prior art device, there is provided a preprinted alignment mark on a recording sheet to determine the reference position by reading an alignment mark by a sensor. In this method, there is a restriction that the paper on which the alignment mark is previously printed must be used. There may be an alternative way to print the alignment mark by the recorder itself. However, it is relatively difficult for the apparatus per se to print an accurate alignment mark. In either case, there is a problem that unnecessary alignment mark remains after the finish of the drawing.

In another prior art, the amount of the paper displacement in the forward or backward direction is converted into the rotational angle of a detection roller which rotates frictionally engaging with the paper. The rotational angle is converted into the number of pulses by an encoder and the number of pulses is counted by an up-down counter (i.e., up-counting for the forward paper displacement and down-counting for the backward paper displacement). From the count value of this up-down counter, the reference position is determined. However, there are such problems that slip between the paper and the detection roller generates an error and that the detection roller causes additional load to the paper displacement.

In another prior art, a paper edge is detected by a photosensor consisting of a pair of light-emitting element and light-receiving element to detect the reference position. In a case where a long recording paper such as a roll paper is used, however, there is a problem that the paper edge must be formed at an suitable portion of the paper.

SUMMARY OF THE INVENTION

Therefore, an object of the present invention is to provide an apparatus for controlling the reference position of the paper, which can accurately determine the reference position without the necessity of an alignment mark on the paper or the formation of an edge on the paper.

In the following descriptions, the recording direction, namely the direction of paper displacement, or paper-feed direction, is denoted as the X axis, and the direction perpendicular to the X axis is denoted as the Y axis. In the present invention, the reference position between the recording paper and the recording head on the X axis is determined at an initialization, and the count value of the counter which counts the number of pulses input to the paper feed pulse motor, is reset at the reference position.

A physical property on the recording paper is measured as a function of the relative position between the recording paper and the recording head in the X axis including the zero point of the count value of the counter. This function is stored as reference data.

Before the second and subsequent recordings on the same sheet, the same physical property on the recording relative is measured as a function of the paper position in the X axis around the zero point of the count value of the counter. This function is called a compared data.

The amount of shift of the compared data along the X axis by which the shifted data has a maximum correlation to the reference data, represents the shift of the reference position for the second time recording, and the count value of the counter must be corrected by this shift amount.

DETAILED DESCRIPTION OF THE PREFERRED EMBODIMENTS

Figure 1:
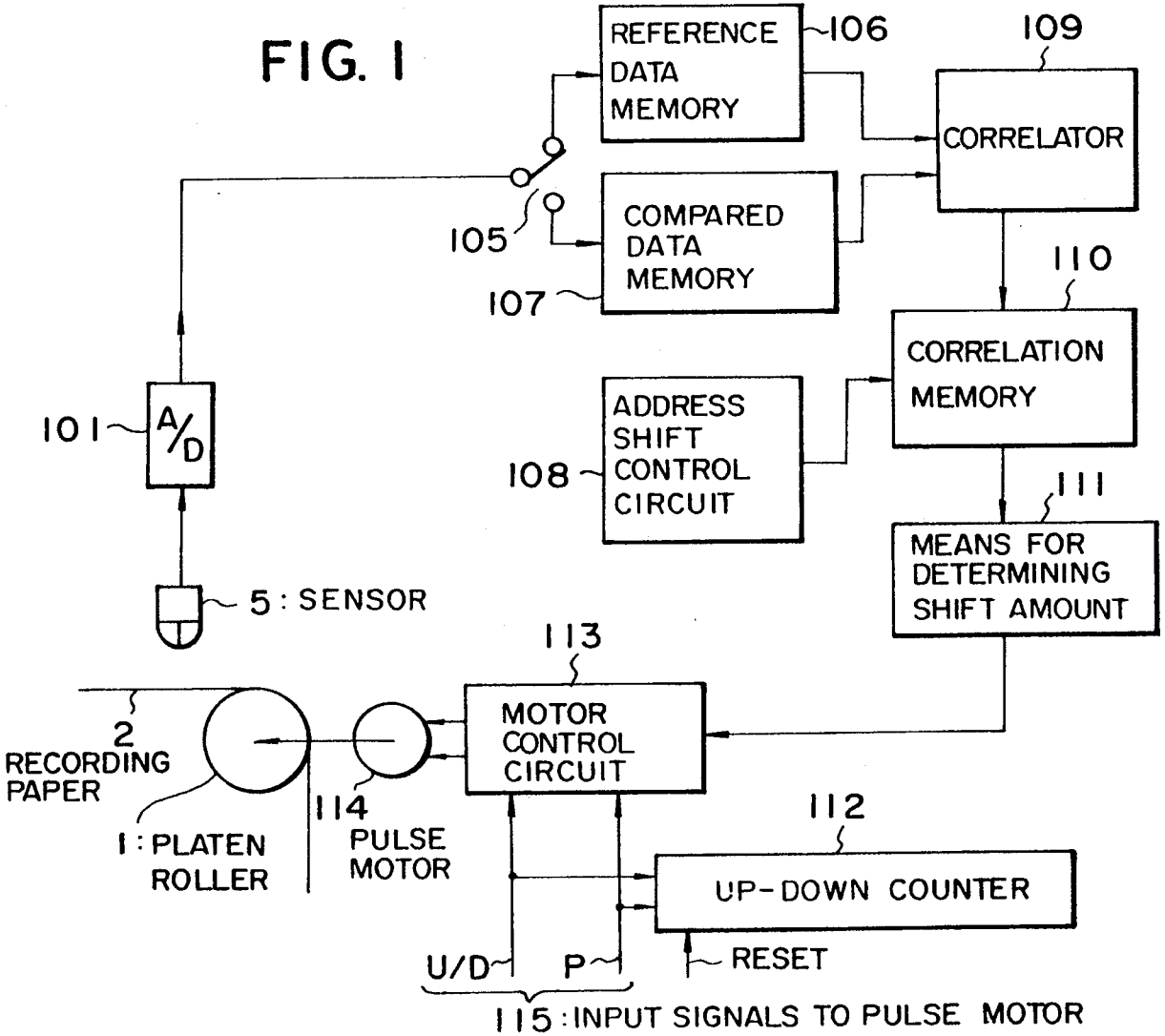
FIG. 1 is a block diagram showing an embodiment of the present invention.

FIG. 1 is a block diagram showing an embodiment of the present invention. In FIG. 1, 1 is a platen roller, 2 is recording paper and 5 is a sensor. Reference numeral 101 denotes an analog-to-digital converter (hereinafter abbreviately referred to as A/D), reference numeral 105 a circuit changing switch, reference numeral 106 a reference data memory, reference numeral 107 a compared data memory, reference numeral 108 a control circuit of address shift amount, reference numeral 109 a correlator which operates a cross-correlation between two functions, reference numeral 110 a correlation memory, reference numeral 111 means for determining shift amount, reference numeral 112 an up-down counter, reference numeral 113 a motor control circuit, reference numeral 114 a pulse motor, and reference numeral 115 signals for controlling the pulse motor.

The paper 2 is fed by the pulse motor 114. It is supposed that the paper feed direction is in the X axis and a recording head (not shown in FIG. 1) is arrayed in the Y axis which is perpendicular to the X axis. Input signals 115 to the pulse motor 114 are constituted by a signal U/D which controls the direction of the normal or reversed motor rotation (positive and negative direction of the paper displacement) and a pulse signal P which rotates the pulse motor 114 by a unit angle. When the pulse motor 114 is rotated by a unit angle, the paper is displaced by a unit incremental quantity u.

The signal U/D also operates the switching of up-count/down-count of the up-down counter 112 (hereinafter referred to as counter), and the pulse P is counted by the counter 112. Accordingly, the count value of the counter 112 indicates the relative position in a direction of X-axis on the paper 2 with respect to the recording head.

The sensor 5 is a light-receiving element which converts the strength of reflected light from the paper 2 into an electric signal and measures the strength of reflected light at each point corresponding to each count value of the counter 112.

At initialization, a reference position which is to be defined as a base position of the paper 2 with respect to the recording head is brought to the sensor 5, at which point the count value of the counter 112 is reset to 0.

Next, the paper 2 is displaced by a step of the unit incremental quantity u. At n points of the count values, $0, 1, 2, \ldots (n-1)$, the strength of the reflected light from the surface of the paper 2 is measured and the measured value is stored respectively at the position of address 0 to address $n-1$ of the reference data memory 106 as a digital signal.

After the store into the reference data memory 106 is completed, the first recording is commenced. When the second and the subsequent recordings are performed, it is necessary to revise a 0 point of the counter 112 after writing into the compared data memory 107.

After the first recording is finished, the paper 2 is returned to a position at which the count value of the counter 112 becomes 0. This position should be the reference point. However, there may be cases that position of 0 in the count value of the counter 112 is deviated from the reference position due to various causes. In order to detect this deviation, the contents of the compared data memory 107 are compared to those of the reference data memory 106.

The write into the compared data memory 107 is performed in a same way as the write into the reference data memory 106, except that the write into the compared data memory 107 is performed with respect to number of points $n+k+l$ from $-k$ to $n+l-1$ of the count values of the counter 112. In this case, k and l are integers which are determined by the design, and in normal cases, $k=l$.

FIGS. 2(A) to 2(D) are views for explaining the operation of the correlator 109 of FIG. 1.

Figure 2:
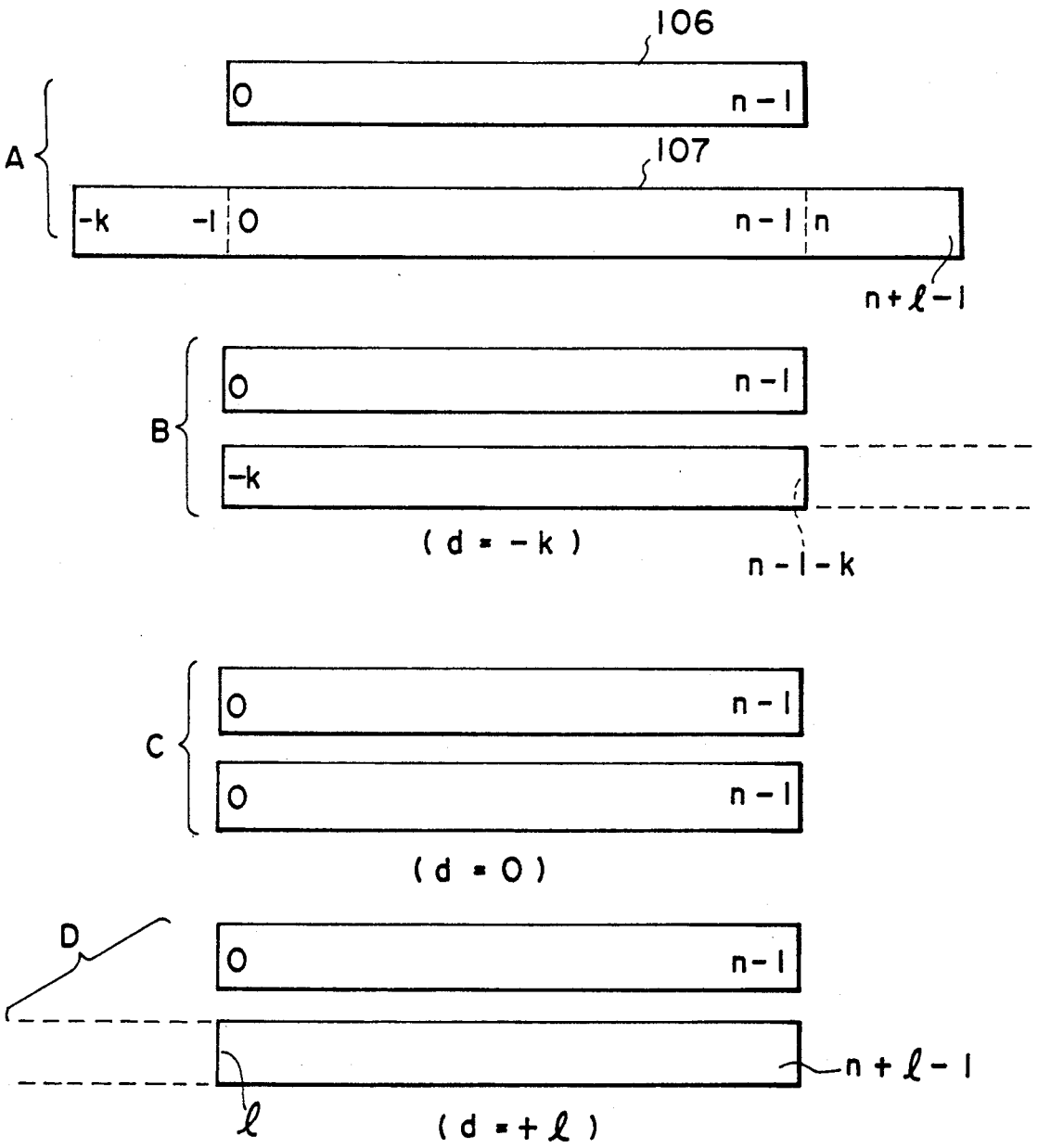
FIGS. 2(A) and 2(D) are views explaining the operation of a correlator of the invention shown in FIG. 1.

FIG. 2(A) shows the contents of the reference data memory 106 and those of the compared data memory 107. In the correlator 109, the products of $f(i)\cdot g(i+d)$ are summed from $i=0$ to $i=(n-1)$, where $f(i)$ is a data at address i of the reference data memory 106 and $g(i+d)$ is a data at address $i+d$ of the compared data memory 107, d representing the address shift amount. The result of the operation is stored at the position of address d of the correlation memory 110. When the computation of the degree of correlation with respect to all the values of d from $d=-k$ through $d=0$ to $d=+l$ is completed, a data which has the maximum value is selected among the contents of the correlation memory 110, and the address d corresponding to the selected data is determined as the shift amount, and is denoted by $\delta$.

Namely, for the following recording, it means that the position of the recording paper of the count value 0 of the counter 112 is not the reference position, but that the point of the count value $\delta$ coincides with the reference position. Accordingly, after the paper is displaced to a position where the count value of the counter 112 becomes $\delta$, the counter 112 is reset to 0 and then, the recording is commenced.

With respect to data stored in the reference data memory 106 and the compared data memory 107, the computation of the correlation degree can be simplified when the number of bits per one data are made small. For example, the strength of the reflected light which is measured by the sensor 5 is expressed by one bit data, and data which exceeds the average value is denoted by logic [1] and data which is less than the average value is denoted by logic [0]. Then, the product $f(i)\cdot g(i+d)$ is indicated by the output of an exclusive-or gate.

Figure 3:
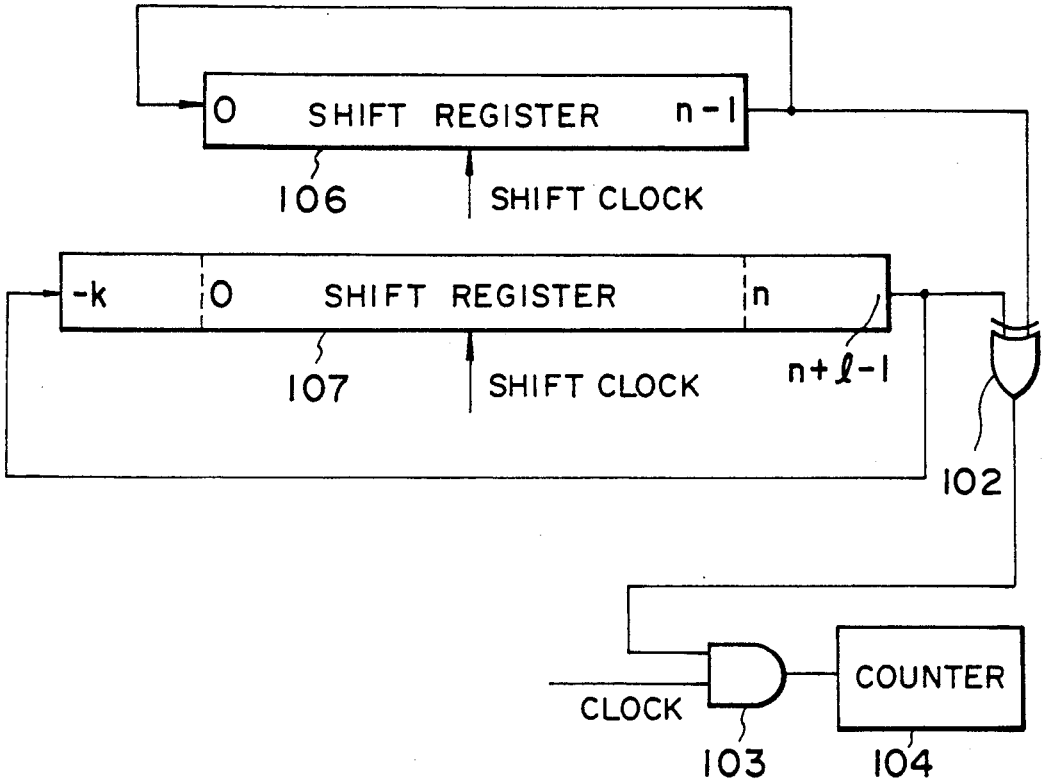
FIG. 3 is a view showing an example of a simplified correlator.

FIG. 3 is a block view showing an example of a simplified correlator, in which reference numerals 106 and 107, respectively, correspond to the reference data memory 106 and the compared data memory 107 in FIG. 1. However, due to the condition that one data is one bit, these memories are constructed by shift registers. A correlator 109 in FIG. 1 is constructed by an exclusive-or gate 102, AND gate 103 and a counter 104. The example shown in this drawing corresponds to $d=1$ in FIG. 2(D).

When, while the shift registers 106 and 107 being simultaneously circularly shifted, their outputs are input in the exclusive-or gate 102, the output of the exclusive-or gate 102 becomes $f(n-1)\cdot g(n+l-1)$, $f(n-2)\cdot g(n+l-2)$, . . . . Thus, the signal of logic [1] is output only when the two input signals of the exclusive-or gate 102 are inconsistent, one signal of the two signals coming from the contents of the reference data memory 106 and the other signal coming from the contents of the compared data memory 107 which is address-shifted by d from the contents of the reference data memory 106. This logic [1] is counted by the counter 104. The count value of the counter 104 when the shift registers 106, 107 are simultaneously right-shifted by n-bits expresses the degree of inconsistency at the address shift of d.

When the shift registers 106, 107 are circularly right-shifted by n-bits, the contents of the shift register 106 are returned to the former state. From that point, when the shift register 107 is further circularly right-shifted by k+l bits, the contents of the shift register 107 are returned to the former state. From that point, the shift register 107 is right-shifted by one bit to change the value of d by one, and the next calculation is performed.

For the computation of the correlation degree, simplified and convenient method can be applied. For example, the absolute values of difference (or squared values of difference) of $f(i)-g(i+d)$ are accumulated from $i=0$ to $i=n-1$, and $\delta$ may be determined by the value of d which gives the minimum in the accumulated value.

After several recordings are performed, there may be cases that the states and conditions at the neighbourhood of the reference point of the paper 2 vary and the contents of the reference data memory 106 which were measured at the time of the initialization do not indicate the present state. In this case, the contents of the compared data memory 107 after the shift amount $\delta$ is determined, may be shifted by an amount of $\delta$ and input in the reference data memory 106.

In the above-described embodiments, the strength of reflected light from the surface of the paper 2 which is one of the physical properties of the paper 2 is utilized. Accordingly, when the surface of the paper 2 is a surface of an entirely smooth sheet as in a case of OHP (over head projector) sheet, the strength of the reflected light from the smooth surface does not become a suitable pattern for the determination of the position. Thus, in this case, an edge of the paper 2 which is in parallel to the X axis and has fine unevenness (concave and convex; change of the position in Y axis direction) produced when the paper 2 is cut, is utilized and an image sensor is used to measure such an unevenness.

Figure 4:
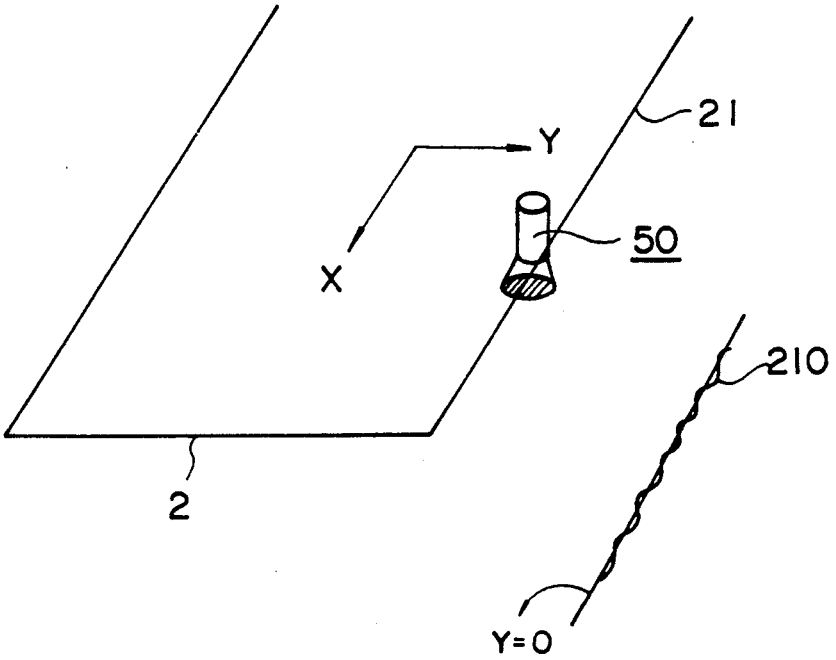
FIG. 4 is a perspective view showing another embodiment of the present invention.
Figure 5:
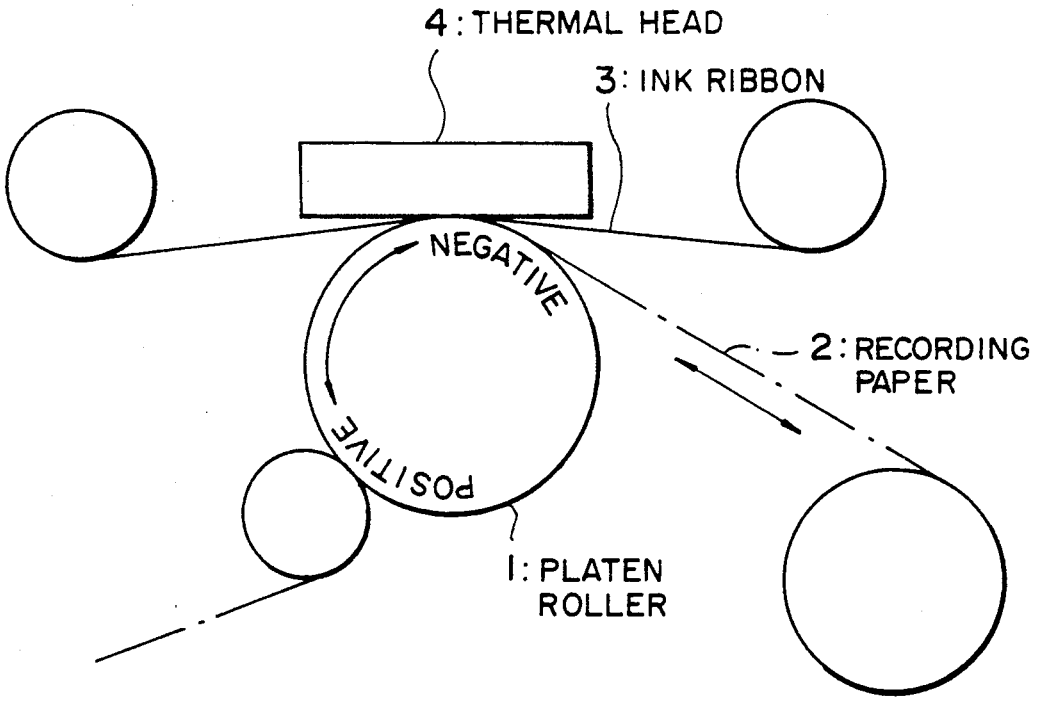
FIG. 5 is a side view showing a polychrome recording apparatus in which this invention is applied.

FIG. 4 is a perspective view showing the relationship between the sensor 50 and the paper 2 of the present invention, in which reference numeral 21 denotes an edge which is in a direction of the paper displacement and is parallel to X axis. The edge may be seen as linear by a naked eye. However, when the edge is magnified, it has an unevenness designated by reference numeral 210. The sensor 50 is, for example, an image sensor which reads out the position in Y axis direction of the edge 210 of the paper 2. By utilization of this pattern of the edge, the reference position is determined.

When the paper 2 is relatively thick, the pattern of the strength of the reflected light from the profile of such paper can be utilized. The present invention has been described with reference to the embodiment shown in FIG. 1, in which the recording paper 2 is driven by a pulse motor 114, and the relative position between the recording paper 2 and the recording head is supervised by the up-down counter 112. But it is apparent that any driving means for displacing the relative position between the recording paper 2 and the recording head, and any supervisory means for supervising this relative position can be used in this invention.

What is claimed is:

1. An apparatus for controlling a reference position of a recording paper in a multiple-time recorder in which a driving mechanism drives the recording paper relative to a recording head for recording on said recording paper in a forward or backward paper-feed direction by unit incremental steps, in which a counter is provided to count the incremental steps, and in which multiple-time recordings are superimposed on a single sheet of said recording paper by aligning the relative position between said recording paper and said head to a predetermined reference position at each recording of the multiple-time recordings, said apparatus comprising:

a sensor for measuring a physical property of said recording paper at points coming within a measuring field of said sensor, said sensor having an output and being located in a position which is fixed in the paper-feed direction relative to said recording head;

means for initialization to reset said counter to 0 (zero) when the recording paper is driven by said driving mechanism to said reference position before commencement of a first recording;

means for preparing n data of f (i) processed from the output of said sensor at counts 0, 1, 2, . . . i . . . $(n-1)$ of said counter, where n is an arbitrary integer determinable by design and f(i) is the processed data corresponding to count i of said counter, and storing these processed data f (i) in a reference data memory at address i before commencement of said first recording;

means for preparing $n+k+l$ data of g(j) processed from the output of said sensor at points from $-k$ to $n+l-1$ (where k and l are respectively arbitrary integers determinable by design, j is an integer from $-k$ to $n+l-1$ and g(j) is the processed data corresponding to count j of said counter), and storing these processed data g(j) in a compared data memory at address j, after completing said first recording and before commencing second and subsequent recordings;

means for calculating a cross correlation between functions f(i) and $g(i+d)$, where f (i) is data at address i of the reference data memory, $g(i+d)$ is data at address $i+d$ of the compared data memory, d is an address shift which is an integer from $-k$ to $+l$, and storing a calculated result at address d of a correlation memory;

means for determining an address value $\delta$ in said correlation memory at which the highest correlation value is stored; and means for positioning the recording paper at a position where said counter indicates $\delta$, and resetting the counter to 0.

2. The apparatus of claim 1 wherein said sensor for measuring a physical property of the recording paper comprises a light receiving element which converts light reflected from a surface of said recording paper into an electrical signal.

3. The apparatus of claim 1 wherein said sensor for measuring a physical property of the recording paper comprises an image sensor for measuring an edge pattern which represents a position of an edge of the recording paper in a direction perpendicular to the paper-feed direction as a function of position of the recording paper in the paper-feed direction.

4. The apparatus of claim 1 wherein further means are provided for writing the data stored in said compared data memory into said reference data memory with an address shift of $\delta$.

5. The apparatus of claim 1 wherein the means for calculating a cross correlation between the two functions f(i) an g(i+d), calculates an algebraic sum of products f (i)·g (i+d) from i=0 to i=(n−1).

6. The apparatus of claim 1 wherein the means for calculating a cross correlation between the two functions f(i) and g(i+d), has means for converting data of the two functions f(i) and g(i+d) to one bit digital data by a same threshold value, and generating a product f(i)·g(i+d) by an exclusive-or gate.

7. The apparatus of claim 1 wherein the means for calculating a cross correlation between the two functions f(i) and g(i+d), calculates a sum of absolute values of the difference {f(i)−g(i+d)} from i=0 to i=(n−1).

8. The apparatus of claim 1 wherein the means for calculating a cross correlation between the two functions f(i) and g(i+d), calculates a sum of squared values of the difference {f(i)−g(i+d)} from i=0 to i=(n−1).

9. A method for controlling a reference position of a recording paper in a multiple-time recorder in which a driving mechanism drives the recording paper relative to a recording head for recording on said recording paper in a forward or backward paper-feed direction by unit incremental steps, in which a counter is provided to count the incremental steps, and in which multiple-time recordings are superimposed on a single sheet of said recording paper by aligning the relative position between said recording paper and said recording head to a predetermined reference point at each recording of the multiple-time recordings, said method comprising:

an initialization step to reset said counter to 0(zero) at said reference point before commencement of a first recording;

a writing step for writing n data of f(i) processed from an output of a sensor for measuring a physical property of said recording paper at counts 0, 1, 2, . . . i . . . (n−1) of said counter, where n is an arbitrary integer determinable by design and f(i) is the processed data corresponding to count i of said counter, in a reference data memory at address i before commencement of said first recording;

a writing step for writing n+k+l data of g(j) processed from an output of said sensor at points from −k to n+l−1 (where k and l are respectively arbitrary integers determinable by design, j is an integer from −k to n+l−1 and g(j) is the processed data corresponding to count j of said counter), in a compared data memory at address j, after completing said first recording and before commencing second and subsequent recordings;

a calculation step for calculating a cross correlation between functions f(i) and g(i+d), where f(i) is data at address i of the reference data memory, g(i+d) is data at address i+d of the compared data memory, d is an address shift which is an integer from −k to +l and storing a calculated result at address d of a correlation memory; and a correction step for finding an amount of address shift $\delta$ which gives maximum correlation, and resetting said counter to 0 at a count of $\delta$ of said counter.

10. An apparatus for controlling a reference position of a recording paper in a multiple-time recorder in which there are provided driving means for changing a relative position between the recording paper and a recording head forward or backward in a recording direction by a desired amount of displacement for recording on the recording paper, supervisory means for supervising said relative position in said recording direction, data storage means for storing data of a reference position between the recording paper and the recording head, wherein multiple-time recordings are superimposed on a single sheet of the recording paper by aligning, at each recording of the multiple-time recordings, the relative position between the recording paper and the recording head according to the data of the reference position stored in said data storage means, characterized in that said apparatus comprises:

measuring means fixed to a point of said apparatus for measuring a physical property of the recording paper as a function of the relative position, said relative position being changed by said driving means supervised by said supervisory means;

pattern obtaining means for obtaining a variation pattern of said physical property from an output of said measuring means when said driving means is changing said relative position between the recording paper and the recording head in a predetermined range including said reference position;

antecedent pattern obtaining means for operating said pattern obtaining means prior to each recording of the multiple-time recordings;

correlation means for detecting a maximum correlation point between a compared pattern and a reference pattern at a current recording of each second and subsequent recordings of multiple-time recordings, said compared pattern being the variation pattern obtained by said antecedent pattern obtaining means for said current recording, and said reference pattern being a variation pattern obtained by said antecedent pattern obtaining means for a recording preceding said current recording; and reference position control means for storing new data of the reference position deduced from said maximum correlation point in said storage means as the data of the reference position.

11. The apparatus of claim 10 wherein said reference pattern used for the correlation at said current recording is derived from the compared pattern obtained by said antecedent pattern obtaining means for a recording immediately before said current recording.

12. An apparatus for controlling a reference position of a recording paper in a multiple-time recorder in which there are provided driving means for displacing the recording paper forward or backward in a paper-feed direction to change a relative position in said paper-feed direction between the recording paper and a recording head by a desired amount of displacement for recording on the recording paper, supervisory means for supervising said relative position in said paper-feed direction between the recording paper and the recording head, data storage means for storing data of the reference position between the recording paper and the recording head, wherein multiple-time recordings are superimposed on a single sheet of the recording paper by aligning, at each recording of the multiple-time recordings, the relative position between the recording paper and the recording head according to the data of the reference position stored in said data storage means, characterized in that said apparatus comprises:

measuring means fixed to a point of the recording head for measuring a physical property of the recording paper as a function of the relative position, said relative position being changed by said driving means supervised by said supervisory means;

pattern obtaining means for obtaining a variation pattern of said physical property from an output of said measuring means when said driving means is changing said relative position between the recording paper and the recording head in a predetermined range including said reference position;

antecedent pattern obtaining means for operating said pattern obtaining means prior to each recording of the multiple-time recordings;

correlation means for detecting a maximum correlation point between a compared pattern and a reference pattern at a current recording of each second and subsequent recordings of multiple-time recording, said compared pattern being the variation pattern obtained by said antecedent pattern obtaining means for said current recording, and said reference pattern being a variation pattern obtained by said antecedent pattern obtained by said antecedent pattern obtaining means for a recording preceding said current recording; and reference position control means for storing new data of the reference position deduced from said maximum correlation point in said storage means as the data of the reference position.

13. The apparatus of claim 12 wherein said reference pattern used for the correlation at said current recording is derived from the compared pattern obtained by said antecedent pattern obtaining means for a recording immediately before said current recording.

* * * * *